US010808209B2

(12) United States Patent
Phang et al.

(10) Patent No.: US 10,808,209 B2
(45) Date of Patent: Oct. 20, 2020

(54) FORMULATIONS FOR APPLYING A HYDROPHOBIC FILM TO A SUBSTRATE

(71) Applicant: ILLINOIS TOOL WORKS, INC., Glenview, IL (US)

(72) Inventors: Tze-Lee Phang, Katy, TX (US); Liliana Minevski, The Woodlands, TX (US); Janice Crayton, Humble, TX (US)

(73) Assignee: ILLINOIS TOOL WORKS, INC., Glenview, IL (US)

( * ) Notice: Subject to any disclaimer, the term of this patent is extended or adjusted under 35 U.S.C. 154(b) by 0 days.

(21) Appl. No.: 13/839,882

(22) Filed: Mar. 15, 2013

(65) Prior Publication Data

US 2014/0272148 A1 Sep. 18, 2014

(51) Int. Cl.
*C11D 17/00* (2006.01)
*C11D 3/37* (2006.01)

(52) U.S. Cl.
CPC ..... *C11D 17/0021* (2013.01); *C11D 3/373* (2013.01); *C11D 3/3742* (2013.01)

(58) Field of Classification Search
USPC ..... 252/174.15
See application file for complete search history.

(56) References Cited

U.S. PATENT DOCUMENTS 4,600,436 A * 7/1986 Traver et al. ..... 106/3
4,790,877 A * 12/1988 Vadasz ..... C09G 1/16 106/3
4,880,557 A * 11/1989 Ohara ..... C11D 3/373 510/189
5,378,271 A * 1/1995 Arimoto ..... B60C 13/001 106/236
6,461,537 B1 10/2002 Turcotte et al.
7,569,232 B2 * 8/2009 Man ..... A01N 37/16 424/405
2004/0171744 A1 * 9/2004 Huang ..... C08J 3/02 524/588
2011/0197465 A1 * 8/2011 Byrne ..... C11D 1/62 34/282

FOREIGN PATENT DOCUMENTS

EP 1184422 A1 3/2002
EP 2514405 A1 10/2012
WO 2006099500 A1 9/2006

OTHER PUBLICATIONS

Advanced Polymer, Inc. (API) "Get the API Advantage . . . " AP-0282 is a self-emulsifiable, high molecular weight silicone additive, forms protective barrier, water resistant—prevents water wear, non-yellowing assures color. www.advpolymer.com.

* cited by examiner

*Primary Examiner* — Nathan T Leong
(74) *Attorney, Agent, or Firm* — Blue Filament Law PLLC

(57) ABSTRACT

A composition is provided that includes a universal hydrophobic active ingredient of modified silicone polymer forming a microemulsion in water, and a water miscible organic solvent to produce a clear and transparent solution that cleans and leaves a hydrophobic film on a glass substrate when dried. A process of applying the same is also provided.

14 Claims, 4 Drawing Sheets

FORMULATIONS FOR APPLYING A HYDROPHOBIC FILM TO A SUBSTRATE

FIELD OF THE INVENTION

The present invention in general relates to a composition for cleaning glass surfaces and rendering the surfaces hydrophobic and a process for the use thereof and in particular, to such a composition amenable to application to a variety of substrates in field operation with minimal re-formulation yet still able to impart the desired cleaning and hydrophobicity to the treated substrates.

BACKGROUND OF THE INVENTION

Automotive glass is exposed to everyday environmental and various traveling conditions. Fallout of dirt particulates, rain, snow, and bug impact, all contribute to soiling the automotive glass. These conditions affect both visual appearance and driving visibility.

Traditionally, to clean glass a surfactant with good wetting property is used. There is no hydrophobic effect on the surface which could improve visibility during driving and enhance driving safety by creating a hydrophobic surface that repels water droplets. Currently, there are cleaning products with hydrophobic coatings in the market. However, the coating hydrophobic effect is either not effective or not cost-effective. Most importantly, the active ingredients that provide the hydrophobic effect are not readily to be used in different areas of applications without substantially changing the formulations or need to use different active ingredients.

Thus, there exists a need for a universal hydrophobic active ingredient that is readily used in a variety of formulations and for a process for the use thereof that is readily applied in the field to a substrate through resort to being added to a windshield washer reservoir from which later the fluid will be sprayed on the windshield, to the conventional trigger spray application, or propellant aerosol, or a sponge or cloth for wipe application onto the substrate desired to clean and produce a hydrophobic film. By creating a hydrophobic surface that repels water droplets as well as by cleaning auto glass without streaking will improve visibility during driving and enhance driving safety.

SUMMARY OF THE INVENTION

A composition is provided that includes a universal hydrophobic active ingredient of a modified silicone polymer forming a micro emulsion in water, and a water miscible organic solvent to produce a clear and transparent solution that cleans and leaves a hydrophobic film on a glass substrate when dried. A process of applying the same is also provided.

DETAILED DESCRIPTION OF THE PREFERRED EMBODIMENTS

Figure 1:
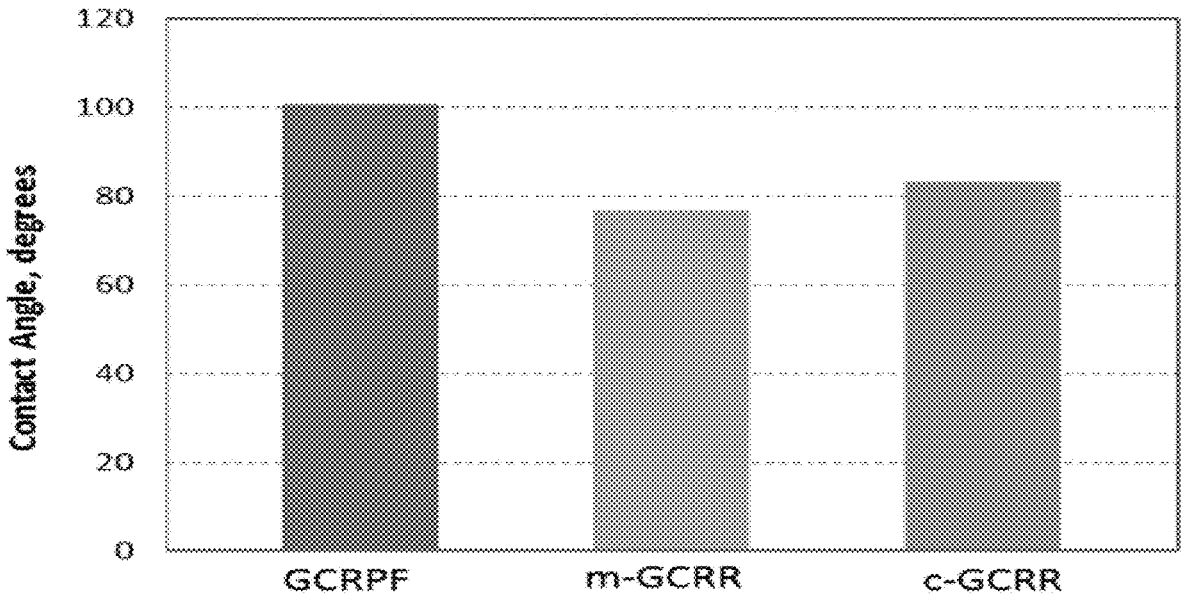
FIG. 1 is a bar graph of contact angle in degrees for an inventive glass cleaner with repellent properties fluid (GCRPF) and comparative non-inventive products before wash.

The present invention has utility as glass cleaner with repellent properties fluid (GCRPF) that forms a film on a substrate to render the underlying substrate hydrophobic. The present invention has the attribute of being amenable to application as a wipe-on or spray applied composition that forms a film without resort to the complex deposition processes that characterized prior art systems. As a result of the durability of the hydrophobic film imparted to a substrate by the inventive composition, the substrate needs to be cleaned less often. An inventive composition is also amenable to formulation independent of, and therefore devoid of volatile organic compounds (VOCs).

While the present invention is further detailed with respect to application to a glass substrate such as a vehicle window, or building window, it is appreciated that an inventive composition is readily applied to numerous other substrates to impart hydrophobic films thereto. To the extent that an inventive composition is described herein with respect to total weight percentage of various components, these amounts are provided independent of propellants that are used in pressurized aerosol packages.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

An inventive composition is provided based on a silicone microemulsion system in water with a minor quantity of organic solvent to product a clear and transparent solution. In some embodiments of the present invention, a wetting agent is also present. In still other embodiments, the inventive composition includes a propellant to afford a pressurized aerosol container for dispensing onto a target substrate.

In other embodiments, the silicone microemulsion system based on amino functional silicones that emulsify in a solvent that is more than 5 total weight percent water and in other instances up to 99 total weight percent water to form a stable silicone microemulsion system. An inventive composition in some embodiments also contains a fluorocarbon or hydrocarbon propellant when aerosol delivery is desired. In other embodiments, inventive compositions are applied by consumers by a simple trigger spray or simply by sponging or wiping onto a target substrate.

An inventive composition includes a silicone microemulsion which is capable of forming a hydrophobic film on a glass substrate, as measured by a water droplet contact angle of greater than 90 degrees and typically between 95 and 105 degrees. An inventive composition includes a silicone microemulsion that is a storage stable (thermodynamically stable) dispersion, with the dispersed phase having small droplets ranging in size of less than a micron. In certain inventive embodiments, and for ease of formulation silicone compounds are selected that self-emulsify in water. The loadings of the microemulsion are limited to maintain clear and transparent solutions that follow from the small size of the dispersed phase. Transparency is an aesthetic aspect that enhances consumer acceptance of an inventive composition.

Silicone compounds suitable for the preparation of the silicone microemulsions of the present invention illustratively include amino functional silicone fluids having a viscosity range from 40 centistokes (cSt) to 500,000 cSt at room temperature, as well as blends of emulsifiable silicone-based polymers. The structures and properties of silicone-based polymers able to form microemulsions in an inventive composition illustratively include those detailed in U.S. Pat. Nos. 4,600,436; 4,880,557; and 5,378,271. The amino modified silicone compounds of the invention are present in the range of 0.05 to 20 total weight percent. It is appreciated that innovative glass cleaner formulations imparting hydrophobic properties are comprised of previously manufactured microemulsion, more specifically from amino modified, mildly cationic silicone fluids with 30% solid content and pH ranging from 6.5 to 7.5. In addition wetting and/or cleaning agents, and media to control stability and/or product environmental depending performance requirements.

In certain embodiments of the invention, a wetting agent is present in an amount to reduce the surface tension of the composition to the extent that the composition is able to wet a glass target surface. A wetting agent is chosen that is compatible with the silicone microemulsion system. Wetting agents operative herein illustratively include various classes of wetting surfactants for reducing interfacial tension at the substrate-water and/or oil/water interfaces for easy removal of soils or solvents such as glycol ethers, alcohols and ketones, Anionic, such as linear alkylbenzene sulfonates, alcohol sulfates, alcohol ether sulfates, alcohol ethoxylated sulfates, alpha olefin sulfonates, alphasulfomethyl ester; and nonionic, such as alcohol ethoxylates, alkyl phenol ethoxylates. Alkanolamides, alkylglucosides; surfactants are used as wetting agents. It should be appreciated that each of the above wetting agents is commercially available in at least one form. A wetting agent, if present, in an inventive composition is present from 0.05 to 5 total weight percent.

The silicone polymer based microemulsion, wetting agent (if present) and additives (if present) are dissolved or suspended in a solvent system that includes water and a miscible organic solvent. The organic solvent is at least one of acetone, isopropanol, methanol, ethylene glycol monobutyl ether, propylene glycol, dipropylene glycol methyl ether, propylene glycol n-butyl ether typically present from 5 to 35 total weight percent, with the proviso that a de-icer fluid has methanol present in lieu of water where water represents the minor phase by weight. Organic solvents operative herein illustratively including $C_1$-$C_4$ alcohols, acetone, ($C_1$-$C_4$)—O—($C_1$-$C_4$), ethylene glycol butyl ether, dipropylene glycol methyl ether, and combinations thereof. Preferably, the solvent system is 5-90 percent by weight of an inventive composition. Preferably, the organic solvent is VOC exempt. As used herein, "VOC" is defined as a compound listed on the United States Environmental Protection Agency Master List of Volatile Organic Compounds.

An inventive composition optionally includes a halocarbon or hydrocarbon propellant in instances when an aerosol delivery system of an inventive composition is desired. Aerosol propellants operative herein illustratively include difluoroethane, trifluoroethane; alkanes such as butane, pentane, isobutane; propane; ethers such as dimethyl ether and diethyl ether; nitrogen; carbon dioxide; and combinations thereof. The resultant formulation inclusive of a propellant is sealed within a conventional metal aerosol canister and applied by spray application as is conventional to the art.

In certain embodiments of the invention, various additives enhance a property of an inventive composition; the property illustratively including storage stability, film formation, film durability and cleaning properties. Additives are provided such as a dye to modify the color of an inventive composition, a bitterant such as a denatonium benzoate, a surfactant, light stabilizers, defoamer, corrosion inhibitors or combinations thereof. Each additive independently is typically in an inventive composition in an amount from 0 to 3 total weight percent, while in other specific embodiments, each is present from 0.01 to 0.5 total weight percent.

A defoaming agent is present in certain embodiment in an amount present to inhibit surfactant foaminess, if desired, and allow for smooth formation of a hydrophobic film produced from an inventive composition. Defoamer agents operative herein illustratively include silicone-based defoamers; mineral oil-based defoamers, and mixtures of foam destroying polymers and hydrophobic solids such as polyurias, as are known to the art. Specific exemplary silicone-based defoamers illustratively include silica-filled polydimethyl siloxane and polyether-modified polysiloxanes.

A corrosion inhibitor operative herein illustratively includes sodium benzoate, triethanolamine dinonylnaphthalene, boric acid-triethanolamine salt, phosphoric acid-triethanolamine salt, ammonia, triethanolamine, capryloamphoprionate, and mixtures thereof.

An inventive composition is readily stored in glass, metal, or plastic containers made of plastics such as polyethylenes, polypropylenes, nylons, PVC, or PET, or aerosol cans or soaked wipe substrate.

While it should be appreciated that there is virtually no limit as to the nature of a substrate to which an inventive composition is applied to as to form a hydrophobic film, with the proviso that the substrate is not dissolved or otherwise damaged through exposure to an inventive composition, exemplary substrates that are exposed to environmental conditions in which water droplet nucleation can occur on the substrate and have optical transmission attributes in their usage illustratively include optically transparent or translucent substrates formed of polystyrene, polycarbonate, polymethyl methacrylate, quartz glasses, silicate glasses, and ceramics.

Typical and preferred compositions according to the present inventions are provided in Table 1.

TABLE 1

Inventive Composition (amounts in total weight percent exclusive of optional propellant)

| Ingredient | Typical | Preferred |
|---|---|---|
| Silicone micromulsion | 0.05-10 | 0.2-3 |
| Wetting agent | 0-5 | 0.1-10 |
| Cleaning solvent | 1-90 | 2-10 except for deicer or windshield wiper fluid |
| Light stabilizer | 0-1 | 0-0.2 |
| Defoamer | 0-1 | 0.01-0.5 |
| Corrosion inhibitor | 0-2 | 0-1 |
| Solvent system | to 100% | to 100% |
| Organic: water 0.01-0.8:1* | | |

*ratio for windshield wiper fluid and deicer inverted.

An inventive composition is readily provided as a kit in the form of a bottle, wipe or aerosol canister. The bottle optionally equipped with a pump- or spray-trigger. With the provision of an optional wipe remove excess composition, along with instructions for doing so, an inventive kit is operational. The instructions providing details as how to prepare a substrate, apply the inventive composition, removal of excess from the substrate and the time and properties of the film so applied. The instructions can also provide details as to how the composition is re-applied after an applied film is worn.

The present invention is further detailed with respect to the following non-limiting examples that are provided to further illustrate the preparation of specific inventive compositions and certain attributes associated with the resulting films on substrates.

Example 1

Glass Cleaner with Repellant Properties Fluid (GCRPF)

A formulation for glass cleaner with repellant properties fluid (GCRPF) contains 1 total weight percent of a silicone microemulsion:

| | |
|---|---|
| DI Water | 94 wt % |
| Acetone | 5 wt % |
| Silicone microemulsion | 1 wt % |

In water based GCRPF, acetone is used as cleaning agent and solvent. The silicone microemulsion which may be present from 0.1 to 10% is microemulsion and hence forms a clear and transparent solution.

Example 2

Windshield Washer Fluid Additive (WWFA)

General formula for WWFA is shown below from following table:

| WWFA | (1) wt. % | (2) wt. % |
|---|---|---|
| DI Water | 90.70 | 87.80 |
| IPA 99% Anhydrous | 1.20 | 1.20 |
| Methanol | | 3.00 |
| silicone microemulsion | 6.80 | 6.80 |
| Ethylene Glycol Monobutyl Ether | 1.30 | 1.20 |

Water based Windshield Washer Fluid Additive formula contains glycol ether solvent as cleaning, wetting, and degreasing agent; isopropyl alcohol is added for surface cleaning and drying purposes as well as for reducing surface tension of glass. Some formulations may contain methanol for cleaning and freezing benefit; and universal ingredient amino modified silicone microemulsion, which may be present from 5 to 20%.

Example 3

Windshield Washer Fluid (WWF)

While ranges of ingredients may vary depending on type of WWF some general formulations are shown below.

| | WWF | |
|---|---|---|
| | All Season & Bug Removers WWF wt. % | Winter & De-icer WWF wt. % |
| DI Water | 68.95 | 64.58 |
| Methanol | 30.00 | 35.00 |
| Silicone microemulsion | 0.40 | 0.40 |
| Biterant (Bitrex PG) | 0.02 | 0.02 |
| Ethylene Glycol Monobutyl Ether | 0.63 | |
| Dye | 0.001-0.29 | |

Water based Windshield Washer Fluids are designated as All Season, Bug Remover, Winter, De-Icer and combination thereof. WWF is water based and contains methanol to fight freezing, glycol ether solvent as cleaning, wetting, and degreasing agent; and amino-modified silicone microemulsion, which may be present from 0.1 to 10%. Dye (Drimarine K3R CDG Orange; FD&C Yellow; Dayglo Orange ECX #15) is dispersed and added aesthetics.

Example 4

De-Icer Fluid (DIF)

While ranges of ingredients may vary depending on application (trigger spray or aerosol) general formulation is shown below. Amino-modified silicone microemulsion, AP-0282, which may be present from 0.05 to 20%

| De-icer Fluid | wt. % |
|---|---|
| DI Water | 10.00 |
| Propylene Glycol | 5.00 |
| Methanol | 84.78 |
| Silicone microemulsion | 0.10 |
| Bitterant (Bitrex PG) | 0.02 |
| Hydroxyl terminated nonionic surfactant | 0.10 |

Example 5

Contact angle instrument (Krüss Mobile Drop) was used to measure contact angle of water on a clean-untreated or a clean-treated glass surface. A higher contact angle value indicates better water droplet beading on the surface (hydrophobicity), and hence better repellency and better conditions for water removal from the surface under external force such as blowing wind or gravity.

The durability test was conducted using the Abrasion Tester (BYK) and abraded (with section of a wiper squeegee) for a prescribed interval of cycles with water dripping from the sprinklers.

An in-house built sliding angle instrument was used to measure the sliding angle of a water drop on a glass surface. The angle at which the water droplet starts sliding down the glass surface (due to gravity force) was recorded as the sliding angle. The lower the sliding angle value, the easier the water droplet rolls-off the glass surface.

ASTM D 1003 was used to quantitatively measure some optical properties of the glass. Specifically, the light transmittance (T), haze (H), and clarity (C) of the glass were measured. The difference, Δ, of T, H, or C between before and after product application is used as a measure of the cleaning effectiveness of the product:

$$\Delta=\chi_c-\chi_b$$

where $\chi_c$ represents T, H, or C after cleaning or applying product and $\chi_b$ is the corresponding parameter before cleaning or applying product. A clean glass will have a higher T and C and lower H than a dirty glass.

An in-house built Ice Adhesion test unit was used to measure the force required to detach an ice cube/ice block from the glass surface. To make an ice cube, water is poured into a cup and placed in the freezer, which is then adhered to a clean-untreated or a clean-treated glass panel. After at least an hour of settling an external force was used to pull the ice cube from the glass panel. Smaller the force necessary to detach the ice cube from the glass panel, the less adhesive is the ice cube to the glass surface.

Example 6

To test if the glass surfaces cleaned and treated with Glass Cleaner with Repellant Properties Fluid (GCRPF) will improve the water droplet contact angle on the glass surface several glass panels were used to apply the formula and then contact angle (CA) measurements were taken. Before Wash (BW)=after product application, before rinse with water; After Wash (AW)=after rinse with water.

The innovative formula GCRPF has an average CA of 100.5° before wash (BW) and 101.8° after wash (AW) (FIG. 1). These values show desired improvement as compared to the m,c-GCRR, which have average CA of 76.9° BW and 81.5° AW. The contact angle improvements (23.6° BW and 20.2° AW) of the GCRPF over the m-GCRR are statistically significant with 95% confidence level.

In general, the higher the CA, the more spherical the rainwater droplets are, and hence better repellency and better conditions for easier rolling away from the surface under external force such as blowing wind or gravity. This results in better visibility if one looks through the glass.

Figure 2:
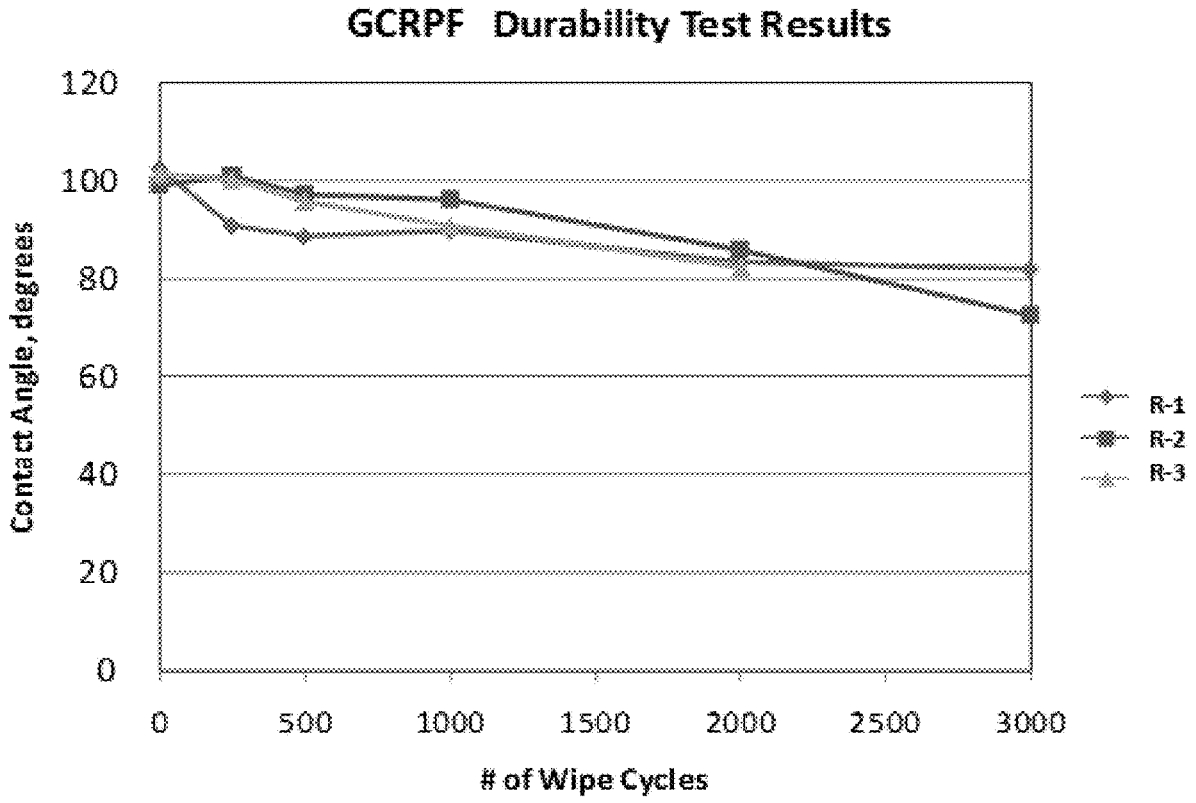
FIG. 2 is a plot of contact angle as a function of abrasion cycles for GCRPF of FIG. 1.

The durability test was conducted to see how the contact angle changes with the number of abrasion wipe cycles. The treated panels were abraded and after the prescribed wipe cycle, the panels were removed from the tester, air dried, and the water contact angle was measured. As expected, the results showed that the contact angle slowly decreased with number of abrasion wipe cycles, (FIG. 2).

Example 7

Figure 3:
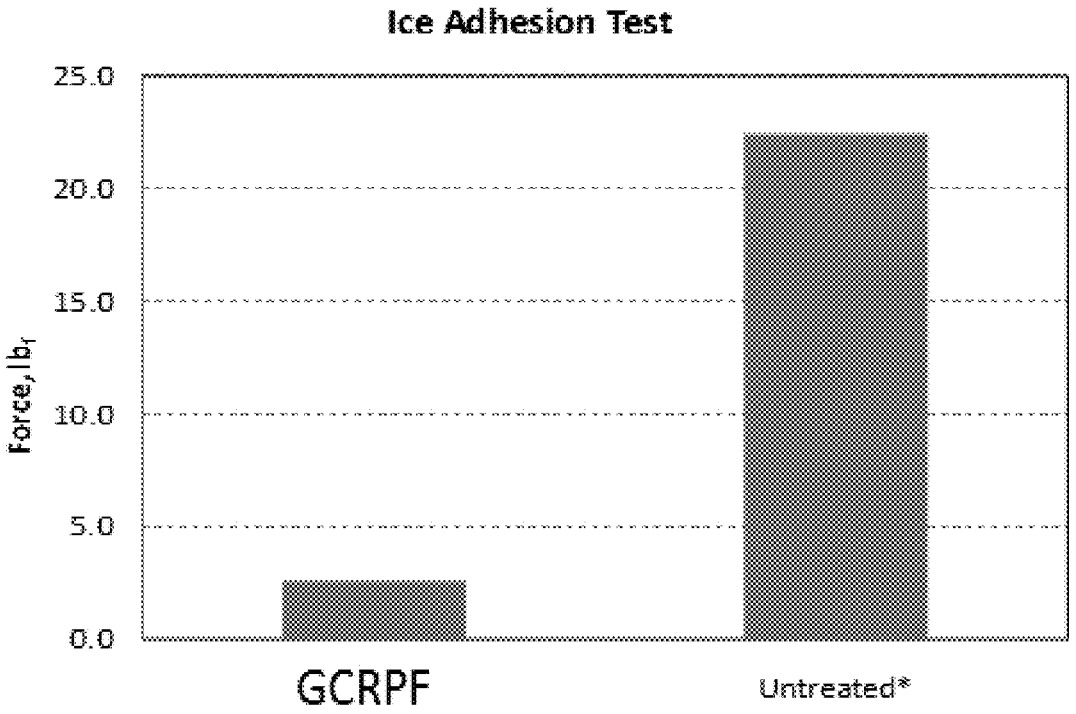
FIG. 3 is a bar graph of ice adhesion for an inventive GCRPF and a comparative of untreated glass.

To test if the glass surfaces cleaned and treated with Glass Cleaner with Repellant Properties Fluid (GCRPF) will improve the removal of sleet/snow/ice, ice adhesion test was conducted. Results showed that the average force required to detach the ice-cubes on the glass surfaces that were treated with innovative GCRPF formula was about 2.6 $lb_f$ (FIG. 3, Table 2). Contrary to treated glass, the force required to detach the ice cubes from the untreated glass surfaces was so great that the experiments were stopped before ice cubes could be removed from the panels. Hence, the actual force was much higher than the reported force of 22.4 $lb_f$ (FIG. 3, Table 1). The test demonstrated with 95% confidence level that the ice cubes have extremely low adhesion to the glass treated with GCRPF.

TABLE 1

Results of the ice adhesion test.

| | Average Force Required to Detach the Ice from Surface($lb_f$) | |
|---|---|---|
| Panel No. | GCRPF | Untreated* |
| 1 | 1.9 | >19.25 |
| 2 | 2.8 | >27.35 |
| 3 | 3.1 | >20.6 |
| Average | 2.8 | 22.4 |

*= the experiments were stopped before ice cubes could be removed from the panels.

Example 8

Figure 4A:
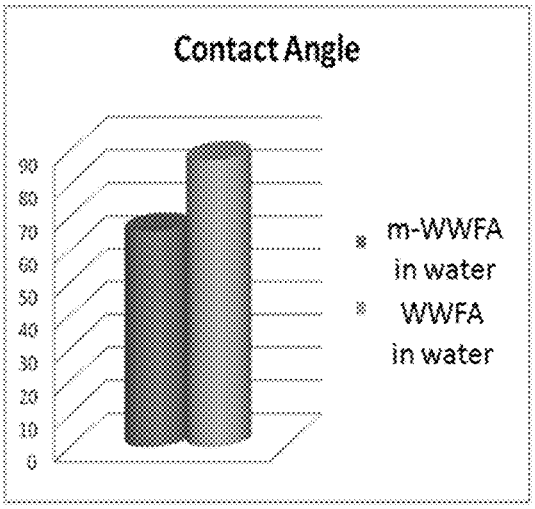
FIG. 4A is a bar graph of contact angle for an inventive composition (WWFA) and comparative non-inventive Windshield Washer Fluid Additive.
Figure 4B:
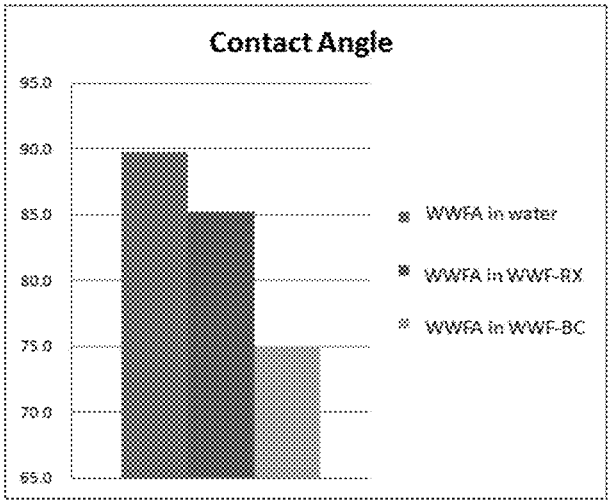
FIG. 4B is another bar graph of contact angle bar graph of contact angle for an inventive composition (WWFA) in water and comparatives of the same in Windshield Washer Fluid.

To test if the glass surface treated with Windshield Washer Fluid Additive (WWFA) repels rain and raindrops bead up, Contact Angle measurement was conducted. The innovative WWFA has higher Contact Angle (CA) of about 88°, in water which is superior to the current market product m-WWFA with CA of about 68° (FIG. 4A). The innovative WWFA has a CA reading of about 85°, in WWF-RX, and a CA reading of 75°, in another WWF-BC (FIG. 4B). In general, higher the CA, the more spherical the rainwater droplets are, and hence easier to roll away from the surface under external force such as blowing wind or gravity. This results in a better visibility through the treated glass.

Example 9

Figure 5:
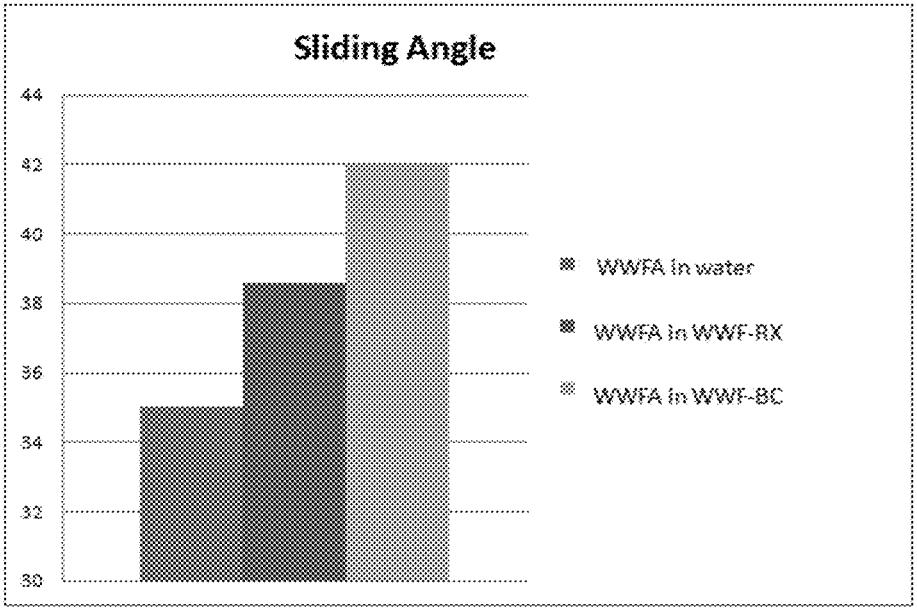
FIG. 5 is a bar graph of slide angle for an inventive composition (WWFA) in water and comparative in Windshield Washer Fluid).

To test if the glass surface treated with WWFA repels rain and raindrops bead up, Sliding Angle measurement was conducted. The innovative WWFA has Sliding angle (SA) of 35 degrees in water and the SA of 39 and 42 degrees in WWF-RX and WWF-BC, respectively (FIG. 5). The lower the sliding angle value, the easier the water droplet rolls-off the glass surface.

Example 10

The composition of Example 1 is sealed in a conventional metal aerosol canister with gaseous nitrogen as a propellant. The canister mixture is applied by spray application to the same substrates as Example 1 with excess liquid being removed from the substrate surface. The resulting film coated substrates are tested and perform in a similar manner as to those in Example 1.

Patents and publications mention the specification are indicative of the levels of those skilled in the art to which the invention pertains. These patents and publications are incorporated herein by reference to the same extent as if each individual patent or publication was specifically and individually incorporated herein by reference.

The forgoing description is illustrative of particular embodiments of the invention, but is not meant to be a limitation upon the practice thereof. The following claims, including all equivalents thereof are intended to define the scope of the invention.

The invention claimed is:

1. A hydrophobic composition comprising:

a hydrophobic active ingredient of an amine modified silicone polymer based preformed microemulsion, the amine modified silicone polymer based preformed microemulsion being present from 0.2 to 3 total weight percent;

water present from more than 80 to 98 total weight percent; and an organic solvent that is miscible with water, wherein said organic solvent is at least one of acetone, isopropanol, methanol, ethylene glycol monobutyl ether, dipropylene glycol methyl ether, or propylene glycol n-butyl ether, said hydrophobic active ingredient, said water, and said organic solvent forming a transparent solution having a pH ranging from 6.5 to 7.5.

2. The composition of claim 1 further comprising a wetting agent.

3. The composition of claim 1 wherein said amine modified based preformed microemulsion, and said organic solvent are devoid of volatile organic compounds (VOCs).

4. The composition of claim 1 further comprising at least one additive of a dye, a biocide, a surfactant, a defoamer, a light stabilizer, and a corrosion inhibitor.

5. The composition of claim 1 wherein an amine modified silicone polymer of said amine modified silicone polymer based preformed microemulsion is amino functional silicone fluids having a viscosity range from 40 centistokes to 500,000 centistokes, the viscosity measured at room temperature.

6. A hydrophobic composition consisting of:

a hydrophobic active ingredient of an amine modified silicone polymer based preformed microemulsion, the amine modified silicone polymer based preformed microemulsion being present from 0.2 to 3 total weight percent;

water present from more than 80 to 98 total weight percent;

an organic solvent that is miscible with water, wherein said organic solvent is at least one of acetone, isopropanol, methanol, ethylene glycol monobutyl ether, dipropylene glycol methyl ether, or propylene glycol n-butyl ether, said hydrophobic active ingredient, said water, and said organic solvent forming a transparent solution having a pH ranging from 6.5 to 7.5; and an optional additive of at least one of a dye, a bitterant, a surfactant, a defoamer, a light stabilizer, and a corrosion inhibitor.

7. A hydrophobic composition comprising:

a hydrophobic active ingredient of an amine modified silicone polymer based preformed microemulsion, the amine modified silicone polymer based preformed microemulsion being present from 0.2 to 3 total weight percent;

water present from more than 80 to 98 total weight percent;

an organic solvent that is miscible with water, wherein said organic solvent is propylene glycol, said hydrophobic active ingredient, said water, and said organic solvent forming a transparent solution having a pH ranging from 6.5 to 7.5.

8. The composition of claim 7 wherein an amine modified silicone polymer present in said amine modified silicone polymer based preformed microemulsion self emulsifies in water.

9. The composition of claim 7 further comprising a wetting agent.

10. The composition of claim 7 wherein said amine modified silicone polymer based preformed microemulsion, and said organic solvent are devoid of volatile organic compounds (VOCs).

11. The composition of claim 7 further comprising at least one additive of a dye, a biocide, a surfactant, a defoamer, a light stabilizer, and a corrosion inhibitor.

12. The composition of claim 7 wherein an amine modified silicone polymer of said amine modified silicone polymer based preformed microemulsion is amino functional silicone fluids having a viscosity range from 40 centistokes to 500,000 centistokes, the viscosity measured at room temperature.

13. A process for applying a hydrophobic film to a substrate consisting of:

applying the composition of claim 1 to the substrate;

and removing excess from the surface to form the film.

14. The process of claim 13 wherein applying is with a spray, soaked wipe.

* * * * *